US006890115B2

(12) United States Patent
Le Moing

(10) Patent No.: US 6,890,115 B2
(45) Date of Patent: May 10, 2005

(54) APPLICATOR ASSEMBLY, APPLICATOR SYSTEM, AND METHOD OF USING THE APPLICATOR ASSEMBLY

(75) Inventor: Krist ll Le Moing, Paris (FR)

(73) Assignee: L'Oreal S.A., Paris (FR)

( * ) Notice: Subject to any disclaimer, the term of this patent is extended or adjusted under 35 U.S.C. 154(b) by 41 days.

(21) Appl. No.: 10/316,104

(22) Filed: Dec. 11, 2002

(65) Prior Publication Data

US 2003/0133737 A1 Jul. 17, 2003

(30) Foreign Application Priority Data

Dec. 11, 2001 (FR) ..... 01 15994

(51) Int. Cl.[7] ..... B43K 21/00

(52) U.S. Cl. ..... 401/82; 401/55; 401/266; 132/293; 132/317; 132/320

(58) Field of Search ..... 401/54, 52, 62, 401/81, 82, 86–88, 103, 139, 148, 149, 265, 266; 132/293, 297, 317, 318, 320

(56) References Cited

U.S. PATENT DOCUMENTS

| | | | | |
|---|---|---|---|---|
| 1,309,495 A | | 7/1919 | Walker | |
| 1,524,008 A | | 1/1925 | Anastasia | |
| 1,899,386 A | | 2/1933 | Flosi | |
| 2,450,919 A | | 10/1948 | Runnels | |
| 2,837,756 A | * | 6/1958 | Barlow et al. | 401/266 |
| 2,930,384 A | | 3/1960 | Strain et al. | |
| 3,203,024 A | * | 8/1965 | Hawkins et al. | 401/266 |
| 3,488,126 A | | 1/1970 | Avallone | |
| 3,775,014 A | | 11/1973 | Rosborne | |
| 3,947,971 A | | 4/1976 | Bauer | |
| 4,665,901 A | | 5/1987 | Spector | |
| 4,935,158 A | | 6/1990 | Aszman et al. | |
| 4,969,225 A | | 11/1990 | Schubert | |
| 4,983,061 A | | 1/1991 | Demarest | |
| 5,131,773 A | | 7/1992 | Gueret | |
| 5,904,151 A | | 5/1999 | Gueret | |
| 6,082,919 A | | 7/2000 | de Laforcade | |
| 6,099,184 A | | 8/2000 | Koptis | |
| 6,467,981 B1 | * | 10/2002 | Gueret | 401/265 |

FOREIGN PATENT DOCUMENTS

| | | |
|---|---|---|
| EP | 0 775 641 | 5/1997 |
| FR | 782 500 | 6/1935 |
| FR | 783 976 | 7/1935 |
| FR | 1 272 557 | 8/1961 |
| FR | 2 601 865 | 1/1988 |
| FR | 2 642 675 | 8/1990 |
| FR | 2 754 985 | 4/1998 |
| GB | 465 774 | 5/1937 |
| GB | 593 203 | 10/1947 |
| GB | 626 797 | 7/1949 |

OTHER PUBLICATIONS

Co–Pending U.S. Appl. No. 10/073,302, filed Feb. 13, 2002, Gueret, Applicator Assembly, System, and Method.
English language Derwent Abstract of FR 2 601 865, Jan. 29, 1988.

* cited by examiner

*Primary Examiner*—Tuan Nguyen
(74) *Attorney, Agent, or Firm*—Finnegan, Henderson, Farabow, Garrett & Dunner, LLP

(57) ABSTRACT

An applicator assembly may comprise a product comprising a first end portion and a second end portion opposite to the first end portion, wherein the first end portion comprises a first portion surface. The assembly may further comprise at least one application member surrounding at least part of the product, wherein the application member comprises an application face. The assembly may also comprise an actuatable product holder movable relative to the application member, the second end portion of the product being held by the product holder. The assembly may be configured such that, in the absence of actuation of the product holder, the first portion surface is disposed in a first position located substantially level with or below the application face. The assembly may further be configured such that actuation of the product holder causes the first portion surface to be moved to at least a second position relative to application face. The first portion surface may elastically return to substantially the first position when actuation of the product holder ceases. In the absence of actuation of the product holder, the application face may be capable of becoming substantially level with the first portion surface or may be substantially level with the first portion surface.

211 Claims, 7 Drawing Sheets

APPLICATOR ASSEMBLY, APPLICATOR SYSTEM, AND METHOD OF USING THE APPLICATOR ASSEMBLY

The present invention relates to an applicator assembly, which may be used, for example for a cosmetic product, such as a make-up product or a care product, for example. More specifically, such an applicator assembly may be used for applying a blusher, an eyelid colorant, a cheek colorant, a lipstick, a foundation, a care cream, or a sun or hair product, for example. More generally, it may be used for applying any comminutable product.

Various types of applicators may be used to apply cosmetic products, and, in particular, make-up products. For example, applicators of the "matchstick" or "cotton-bud" type are known. Such applicators may be in the form of a rod, to one end of which cosmetic products may be added by immersion or spraying. Such applicators may have the drawback of depositing too much product during application. Furthermore, use of this type of applicator may result in difficulties when trying to smear the product being applied. Lastly, because of their configuration, these applicators may be relatively fragile.

Also known are applicators on the surface of which a product, such as a cosmetic product, for example, may be compressed or compacted. One drawback of these types of applicators may involve their limited capacity. As such, these applicators often may be used as samplers.

Also, applicators of the "powder puff" type are known. These applicators may be used in combination with a case including at least one cup into which cosmetic products may be either poured or compacted. Such "powder puff" compact kits may be relatively expensive.

FR 2 642 675 describes a dispenser for a product which is in solid or paste form, and which is contained in a container having a dispensing orifice. The product may be pushed toward the dispensing orifice by means of a drive mechanism. According to this document, the edges of the dispensing orifice may be covered with a lining such as flocking or a foam which has a small thickness so as to make it possible to apply the product.

Other types of applicators, such as polish applicators, may have structures in which the product to be applied is contained in a tube onto which a block of foam pierced by a hole defining a channel in communication with the tube may be fitted. In these applicators, the product may be brought level with the applicator's application face by exerting pressure on the walls of the tube, so as to constrain the product to pass through the channel of the applicator and to bring it onto the application face. Apart from their size, these devices may not be suitable for products such as make-up products because of the difficulty of correctly dosing the product being applied.

Still other applicators for applying a product, such as a product in powder form, may comprise a compartment in which the powder is contained. The compartment may be made in a block of foam having a free end covered with a strainer in the form of a perforated sheet, a fabric or other porous material, for example. In these devices the product may be free in the compartment, which may make it difficult to apply the product in a dosed fashion. Furthermore, the orifices, pores or other holes made in the sheet that closes the hollow compartment may be subject to rapid clogging, making the device unusable. Finally, such devices may not be suitable for products with a higher consistency, for example lipsticks, foundations, and the like, for example.

Devices for the application of soap to the body may include a bottom forming an integral part of the block of foam in which a compartment is made. The soap contained in this compartment may not be secured to a compartment. In this way, the soap has an increasing axial mobility as the number of uses increases and accordingly the size of the soap decreases. This mobility, in particular axial mobility, may make the application of the product difficult to dose precisely, and the difficulty during application may be further accentuated by the fact that the bottom is not rigid or semi-rigid. Such problems of precision and dosing during application may not, however, be significant when the product is a soap, for example, or another type of product for which dosing is not desired.

FR-2 754 985 discloses an applicator for a comminutable product, including a block of foam having at least one face intended for application of the product and having a hole which opens onto the application face. The block of foam may define at least one compartment in which a stick of product having a free surface may be arranged. The block of foam may be configured so as to pass selectively from a standby position, in which the free surface of the product is located level with or below the application face, into an application position, where the block of foam is at least partially compressed along the axis of the hole, and where the free surface may be substantially level with the application face. In this way, the free surface of the product can be brought level with the application face in response to pressuring of the block of foam against the surface to be treated, so as to compress it. The pressing force may need to become increasingly larger as the height of the stick decreases inside the compartment. Furthermore, in such a configuration the applicator height may be at least as great as the initial height of the stick.

FR 782 500 describes a shaving brush that includes a shaving soap having at least the upper part that may be enclosed by an annular element made of foam, which is intended to collect the soap foam and distribute it. Various mechanisms, for example in the form of screw threads, mechanisms in rack form, or other sliding systems, are described so as to make the soap advance in the direction of the application surface, as its height decreases. With each these mechanisms, there may be a risk that, between two uses, the soap will remain partly outside the block of foam, and will be subjected to damage or premature drying. For example, a user may neglect to move the mechanism after use so as to retract the soap product into a protected position within the applicator.

Furthermore, manipulating the soap may be onerous if it were desired to apply the product to the skin first and then distribute it by means of the applicator, without the product still being in contact with the skin. Such a mode of use does not correspond to the conventional mode of use of a shaving soap.

A shaving brush of a slightly different type may have a configuration such that an application surface of the product can be brought level with the free end of the bristles of the brush in response to an actuation exerted on the structure holding the soap. In the absence of any actuation exerted on the soap holder, the surface of the soap may be located inside a cylindrical sleeve located under the base of the bristles of the brush.

It may be desirable to produce an applicator assembly that may be more comfortable to use than at least some conventional applicator devices.

It may also be desirable to produce an applicator assembly that may be relatively inexpensive to produce and relatively simple to use.

Further, it may be desirable to produce a device in which the size, for example the height, of the applicator is reduced compared with certain conventional devices.

It should be understood that the invention could be practiced without having one or more features of any objects, aspects, or embodiments described herein. In addition, such features are exemplary and at least some of them are set forth in the detailed description which follows.

As embodied and broadly described herein, one aspect of the invention includes an applicator assembly for applying a product, which comprises a product comprising a first end portion and a second end portion opposite to the first end portion, wherein the first end portion comprises a first portion surface. The applicator assembly may further comprise at least one application member surrounding at least part of the product, wherein the application member comprises an application face. The applicator assembly may further comprise an actuatable product holder movable relative to the application member, the second end portion of the product being held by the product holder. The assembly may be configured such that, in the absence of actuation of the product holder, the first portion surface is disposed in a first position located substantially level with or below the application face. The assembly may be further configured such that actuation of the product holder causes the first portion surface to be moved to at least a second position relative to application face, and the assembly also may be configured such the first portion surface elastically returns to substantially the first position when actuation of the product holder ceases. Additionally, the assembly may be configured such that, in the absence of actuation of the product holder, the application face is capable of becoming substantially level with the first portion surface or is substantially level with the first portion surface.

According to another exemplary aspect, the invention may include an applicator assembly comprising at least one application member comprising an application face and defining a passage having an opening in the application face. The applicator assembly may further comprise an elastically moveable product holder configured to be capable of being moved relative to the application member and configured to hold the product such that at least part of the product is received in the passage. The assembly may be configured such that, in response to exertion of an elastic deformation force on the product holder, a surface of the product moves relative to the application member from a first position wherein the product surface does not protrude beyond the opening, to at least a second position wherein the product surface one of protrudes beyond the opening and is substantially level with the opening. In response to the removal of the exertion of the elastic deformation force on the product holder, the product surface may elastically return to substantially the first position.

According to yet another exemplary aspect, the invention may include at least one elastically compressible application member comprising an application face, the application member defining a passage having an opening in the at least one application face. The applicator assembly may further comprise an elastically moveable product holder configured to be capable of being moved relative to the application member and configured to hold the product such that at least part of the product is received in the passage. The application assembly may be configured such that, in response to movement of the product holder relative to the application member, a surface of the product elastically moves relative to the application member. The assembly may be configured such that the product surface moves between a first position wherein the product surface does not protrude beyond the opening, to a second position wherein the product surface is substantially level with or protrudes beyond the opening.

Thus, in an aspect, at the start of using the application assembly, when the first portion surface of the product, which may be a free surface of the product, for example, is close to the application face, placement of the first portion surface and the application face at the substantially the same level may be induced by bringing the application face substantially level with the free surface of the product.

In the absence of any actuation of, and/or in the absence of any movement of the product holder element relative to the application member, and/or in the absence of an elastic deformation force exerted on the product holder element, the application face may be capable of being brought substantially level with the product surface or may be substantially level with the product surface. In response to a force (or pressure) exerted on the application member, for example a force exerted axially on the application face and directed toward the product surface, the application face may be brought substantially level with the product surface.

The application member may comprise an end located on the opposite side from the application face, and, in the absence of any actuation of the product holder element, the first portion surface of the product may have an axial position located between the application face and the end of the application member opposite to the application face. Similarly, in the absence of an elastic deformation force exerted on the product holder element or of movement of the product holder element relative to the application member, the application face may be capable of being brought substantially level with the product surface.

At the end of use of the product, movement of the first portion surface of the product in the direction of the application face in response to a suitable actuation exerted on the product holder element may provide comfort during application. This latter mode of operation may permit a reduction in the pressure to be applied to either the application member or to the surface being treated, and thus may increase the comfort during application.

According to this mode of operation, the user may exert pressure on the product holder element. By doing so, the user may make the first portion surface of the product move in the direction of the application face, until they are both at least substantially at the same level. The user may then subsequently engage the surface of the product with the skin (or other surface to be treated) and deposit the product thereon. Next, the user may relax the force exerted on the product holder element, which may automatically cause the surface of the product to elastically return into a position set back from the application face, i.e., within the passage that may be defined by the application face. The application face, from which the surface of the product is set back, may subsequently be used to smear the applied product and/or distribute it relatively homogeneously over the surface to be treated. According to this mode of operation, the product application function may thus be independent from the spreading (i.e., smearing) function, without a substantial increase in pressure during application as the amount of product, for example, the height of the stick, decreases.

Owing to the mobility of the product holder element relative to the application member, the application member may have a height that is not equal to the height of the product, such as when the product is in the form of a stick, for example. As an example, the height of the application member may be less than the initial height of the product. In this manner, the precision during application may be improved, for example, at the end of use of the device.

The actuation may be a force exerted directly or indirectly on the product holder element. It may be possible to provide an actuation surface suitably coupled to the product holder, and on which the pressure may be applied so as to make the free surface of the product progress in the direction of the application face. The actuation pressure may be exerted along a substantially identical direction to the movement of the product (e.g., product stick) in the direction of the application face, for example, an axial direction, or along a different direction, for example.

According to an aspect, the application member may define a passage over substantially its full height. An end of the passage may define an opening in the application face. The surface of the product may move inside the passage and through the opening in response to the actuation of (e.g., an elastic deformation force exerted on) the product holder. In an exemplary embodiment, the passage may have a cylindrical shape, and the opening may have a cross section substantially equal to the cross section of the passage.

According to an exemplary embodiment, the application member may at least in part be elastically compressible. For example, the application member may comprise an elastically compressible material, and may comprise a foam element. The foam may have open, semi-open cells, or closed cells.

The elastic return may be generated by an elastically deformable element, for example a spring, an elastically compressible element, or a diaphragm made of elastic material. The elastically compressible element may comprise a foam element, such as a foam block.

The applicator may be coupled, for example by adhesive bonding, welding, crimping or magnetic attraction or other suitable mechanisms, onto a support. This characteristic may facilitate movement of the product holder element relative to the application member, and may facilitate implementing the elastic linkage existing between the two. Furthermore, it may be easier to manipulate the application element and/or the applicator assembly since the support may be used as a component for gripping the application element and/or the applicator assembly.

Other coupling mechanisms may also be used to couple the application member and the support. For example, the coupling mechanism may be arranged such that the application face may be substantially insensitive to the axial movement of the product holder element with a view to bringing the product surface substantially level with the application face.

The product holder element and the support may comprise a rigid or semi-rigid material, for example a polypropylene. They may be obtained by molding, for example.

According to an exemplary embodiment, the elastically deformable element may be an element that is elastically compressible, such as a block of foam, a spring, or a diaphragm, for example. A first portion of the element may be coupled to the support and a second portion may be coupled to the product holder element.

The support may comprise a hollow element having a first end terminating in an annular wall on which the application member may be fitted, and a second end that may be open so as to make it possible to mount the product holder element with respect to the application member and/or the support. The product holder element may be held in a mounted position relative to the support via an optionally removable plug. The product holder element may be accessible through the removable plug with a view to exerting a force on it or moving it.

Alternatively, the product holder element may be held in a mounted position relative to the support by one or more beads formed on an internal surface of a side wall of the hollow element. The bead(s), which may be hollow, may be disposed proximate the open end of the support.

According to another embodiment, the elastically deformable element may comprise an elastic diaphragm, having a first portion, for example a peripheral portion, that may be secured to the support, and having a second portion, for example a central portion, that may be secured to the product holder element. The product holder element may be configured in the form of a cup made of rigid material, for example, which may be adhesively bonded to the center of the diaphragm. The elastic element may be molded as a single piece with the product holder and/or the application member and/or the support. For example, the product holder element may be formed by a portion of the diaphragm (for example, substantially the center of the diaphragm) that has a larger thickness and that may be configured in the form of a cup.

The product holder element may be removably mounted with respect to the application member, or with respect to the support. In this way, owing to the removable nature of the mounting between the support (or the application element) and the product holder, the consumer may choose to apply a given product in various ways, in particular with a view to obtaining a different make-up effect. Likewise, with the same application member, the user may choose to change the color, the nature, and/or the texture of the product to apply, merely by changing the product holder associated with the application member and/or support, for example. Between successive applications of different products, via the same application member, the application member may be washed (e.g., under a tap of running water) so that the application of the subsequent product might not be contaminated by possible residues of the first product.

An elastically deformable element, for example when it is configured in the form of a spring, an elastic diaphragm, or a block of compressible material, may form a single integral piece, obtained, for example, by molding with the application member, with the product holder element, and/or with the support. The element which generates the elastic return may be formed as a first portion of a block of foam, and a second portion of the foam block, which may be formed by molding with the first portion or may be a single piece of the same block of foam, may serve as the application member. In an exemplary embodiment, a fixed, protruding portion of the support may "isolate" the application portion from the portion which generates the elastic restoration. The term "isolate" is used herein to mean that a compressive force acting on the first portion of the application member, via the product holder, for example, may not cause compression of the second, application portion of the application member.

In other words, a portion of the application member may be configured to cause the elastic return or elastic movement of the product holder and/or product surface and the portion of the application member may be engaged with the product holder. The application member may comprise an elastically compressible material. The portion of the application member may have a compressibility that differs from the remainder of the application member, for example. In an exemplary aspect, the actuation of the product holder may cause elastic compression of the portion of the application member. In another example, an elastic deformation force exerted on the product holder may cause elastic compression of the portion of the application member. Alternatively, elastic compression of the portion of the application member may cause movement of the product holder relative to the application member.

According to another exemplary embodiment, the passage defined by the application member may have a substantially constant cross section and may open over all of its cross section directly onto the application face. Alternatively, in particular for a product with a somewhat less rigid consistency, it may be possible to make the passage open onto the application face via a strainer, a mesh, a screen, or other similar openworked (porous) structure, for example.

The application assembly may further comprise a removable lid capable, in a storage position, of covering the application face. The lid may be configured to be removed from a covering position covering the application face.

The application member may be made of a material chosen from, but not limited to, polyvinyl chlorides (PVC), polyurethanes, polyethers, polyesters. Alternatively, the application member may be formed by an elastomers, such as SBR (styrene butadiene rubber), NBR (acrylonitrile butadiene rubber), silicones or nitriles, for example.

The application member may comprise a plurality of concentric blocks of foam arranged around the passage. Alternatively, the application member may comprise a plurality of blocks of foam vertically stacked upon each other. Each of the blocks of foam may have a central cavity, and may be stacked in such a way that their respective cavities are substantially aligned so as to form the passage. The characteristics during application, in particular the gentleness or precision, may be altered depending on the configuration of the application member, and in particular on the nature of the foam blocks used. For example, the foam blocks may have differing compressibilities and/or surface textures.

The application member may be configured so as to promote, uniformly or preferentially, the compression of the application member. For example, the application member may comprise at least one groove formed on at least a portion of the application member. The groove may be formed around all or part of the passage. The groove may be disposed on an external surface of the application member.

The application face may comprise flocking, a textile material, a weave, or a screen on an exterior surface portion of the application member.

The product may be in the form of a stick and may be chosen from blushes, face powders, eyeshadows, lip make-ups, foundations, rouges, care products, sun protection products, self-tanning products, or hair products, for example, or any other suitable cosmetic product. The product holder may be configured to fixedly hold the product. The surface of the product may be configured to move in an axial direction between the first position and the second position.

In yet another aspect, the invention may include an applicator system comprising an applicator assembly such as those described above and at least one additional application member. Each of the application members may have an application face for applying product, each of the application faces having a differing characteristic. For example, each of the application members may have a differing compressibility.

The applicator system may further comprise at least one additional product holder, wherein each of the product holders holds a product having a differing characteristic. The differing characteristic may be chosen from at least one of product type and product color.

According to yet another aspect, an applicator system may comprise any of the applicator assemblies described above and at least one additional product holder.

Yet another exemplary aspect includes a method of applying a product to a surface to be treated comprising providing any of the applicator assemblies described above, placing the application face of the application member in contact with the surface to be treated (e.g., an external body portion, such as skin, hair, or at least one nail), and placing the first portion surface of the product in contact with the surface to be treated. The term "providing" is used broadly, and refers to, but is not limited to, making available for use, manufacturing, giving, supplying, obtaining, getting a hold of, acquiring, purchasing, selling, distributing, possessing, making ready for use, and/or placing in a position ready for use.

The placing of the application face in contact with the surface to be treated may comprise compressing the application member. The compressing of the application member may cause the application face to be brought substantially level with the first portion surface of the product so as to enable the placing of the product in contact with the surface to be treated.

According to another aspect, the method may further comprise actuating the product holder so as to move the first portion surface of the product to the second position, wherein the first portion surface of the product one of protrudes beyond the application face and is substantially level with the application face. In yet another example, the method may comprise exerting a force, such as an elastically deformable force, for example, on the product holder so as to move the product holder relative to the application member so as to move the product surface from a first position to at least a second position, wherein the product surface one of protrudes beyond the opening and is substantially level with the opening.

The method may further comprise ceasing the actuation of the product holder and/or removing the force from the product holder after product has been applied so as to cause the elastic return of the first portion surface of the product to substantially the first position.

The method may further comprise smearing the applied product using the application face. In an exemplary aspect, the smearing of the applied product may occur after the first portion surface of the product has elastically returned to substantially the first position.

Besides the structural and procedural arrangements set forth above, the invention could include a number of other arrangements, such as those explained hereinafter. It is to be understood that both the foregoing description and the following description are exemplary. The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is an exploded view of the applicator assembly according to an exemplary embodiment;

Figure 1:
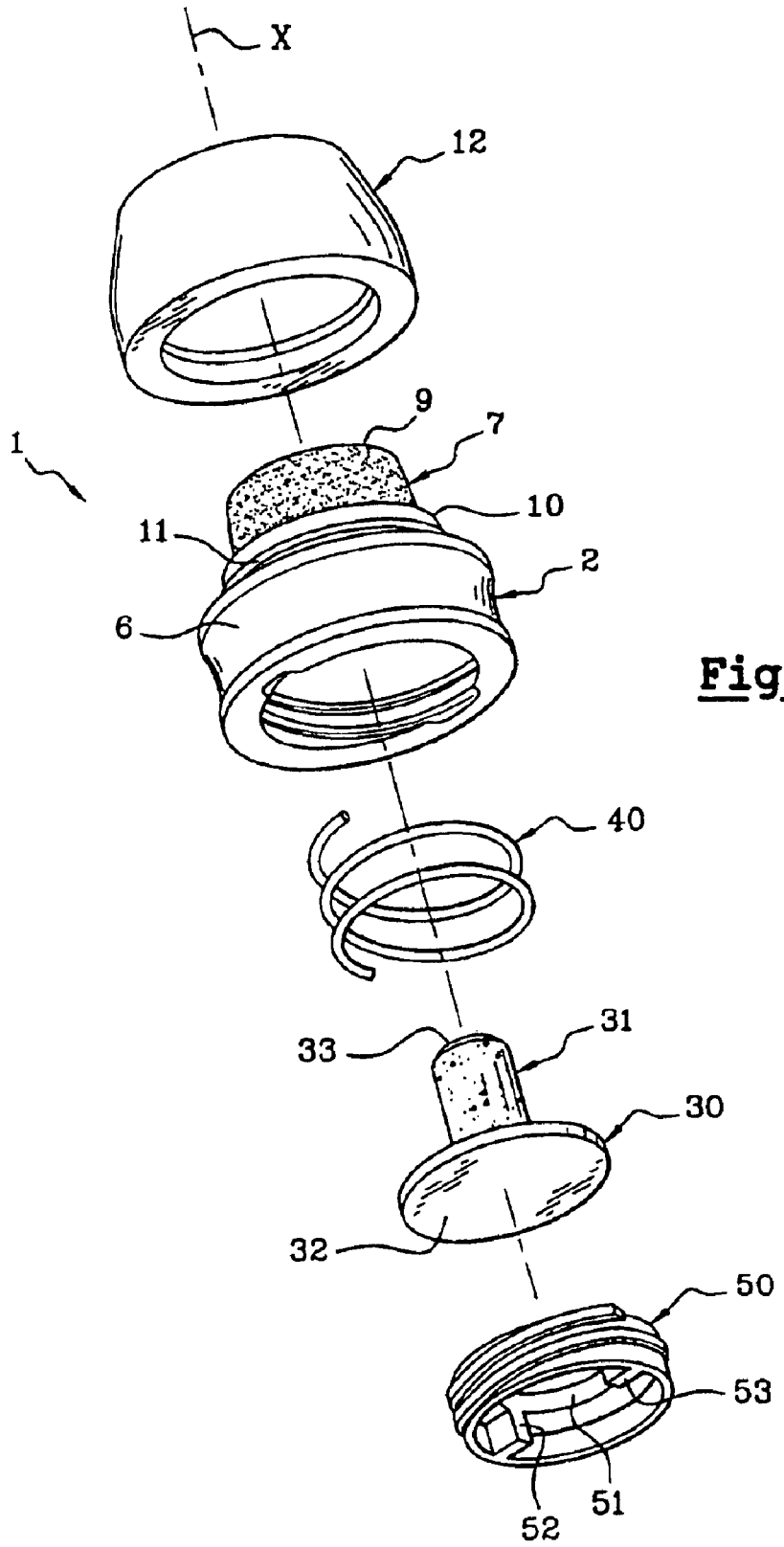

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes and/or superscripts are used to refer to similar parts.

FIGS. 1 and 2A–2C, to which reference is now made, illustrate an applicator assembly for application of a product according to an exemplary embodiment. The applicator assembly 1 has an axis X and comprises an support 2 and a product holder element 30.

The support 2 may comprise a transverse wall 4 pierced at its center by a hole 5. The cross section of the hole 5 may be slightly larger than the cross section of the product 31, which may be in the form of a stick, for example, arranged on the product holder element 30. The transverse wall 4 may be connected to a lateral skirt 6. An end of the skirt 6 opposite to the transverse wall 4 may be open.

An application member 7, which may be in the form of a block of foam, for example, may be adhesively bonded, as schematically shown at 4', to the surface of the wall 4 opposite to the skirt 6. Alternatively, reference numeral 4' may schematically represent a magnetic coupling, a weld, or a crimping engagement of the application member 7 to the transverse wall 4.

The application member 7 may define an axial passage 8 having a cylindrical shape, for example. The cross section of the passage 8 may be similar to the cross section of the hole 5. The passage 8 may extend over the full axial height of the application member. The passage 8 may open via an opening 13 substantially formed at the center of the application face 9 on the opposite side from the transverse wall 4. The opening 13 may have a cross section substantially identical to the cross section of the passage 8.

About half-way along its height, the application member 7 may define an annular outer groove 3 intended to facilitate compression of the application member 7 when the application member 7 is moved over the surface to which product is to be applied, such as skin, for example.

On its side opposite to the lateral skirt 6, the transverse wall 4 may carry a skirt 10 whose outer surface carries a bead 11. The bead 11 may be capable of interacting with a corresponding groove 24 provided on the internal surface of a removable lid 12, which may be configured to removably cover the application face.

The product holder element 30 may comprise a transverse wall 32 having an outer diameter that may be slightly less than the inner diameter of the lateral skirt 6.

On the same side as the transverse wall 32, opposite to the open end of the lateral skirt 6, an axial conduit 36 may be formed. The cross section of the conduit 36 may be slightly smaller than the cross section of the hole 5 passing through the transverse wall 4 of the support 2. The axial conduit 36 also may define a cup capable of receiving a stick 31 of a make-up product P, such as a foundation, for example. The stick 31 may be held inside the cup by crimping, for example. Crimping mechanisms, for example of the fin or groove type (not shown), may be provided in the bottom or on the sides of the cup, in order to improve the retention of the stick 31 in the cup.

The support 2 and the product holder element 30 may be formed by molding, for example, they may be formed by molding polypropylene.

A coil spring 40 may be arranged between the transverse wall 4 of the support 2 and the transverse wall 32 of the product holder element 30. The product holder element 30 may be held in position, despite the force generated by the spring 40, by an annular, removable plug 50 screwed inside the skirt 6 of the support 2. The plug 50 may define an orifice 51 which, as will be seen in more detail below, may make it possible to access the product holder element 30 with a view to raising the stick of product 31 in the direction of the opening 13 in the application face 9. Two diametrically opposite radial ribs 52, 53 may facilitate rotation of the plug 50 one way or the other.

Figure 8:
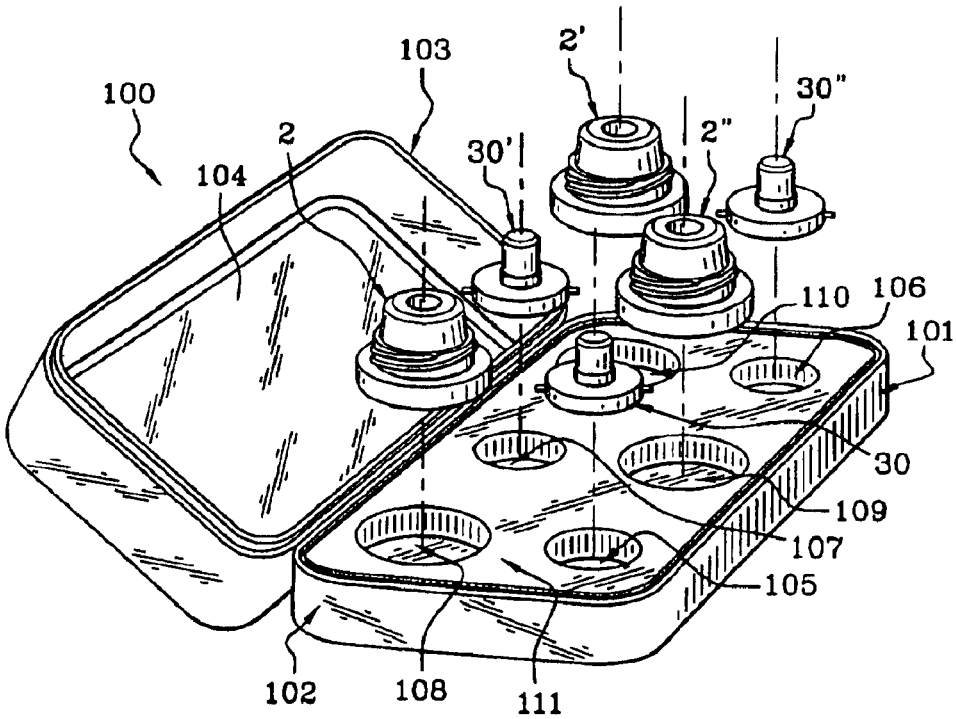
FIG. 8 is a perspective view of an exemplary embodiment of an applicator system.

The support 2 and product holder element 30 may be detached in order to change the product associated with a given application member or to change the application member associated with a given product, as desired. For example, FIG. 8 illustrates an exemplary embodiment of an applicator system 100. The applicator system 100 may comprise a plurality of product holders 30, holding products 30', 30", etc. of differing characteristics, such as product type, product color, or the like. The system may further comprise a plurality of application members 2, 2', 2", each associated with its own support, and which may also have differing characteristics, such as compressibility, surface texture, and the like. Such a system 100 may further comprise a case 103 and cut-out apertures 105–110 in the case for holding the various application members and supports and product holders holding product. A system 100 may permit the various product holders/products combinations to be interchanged with the various support/application members, as desired.

Figure 2A:
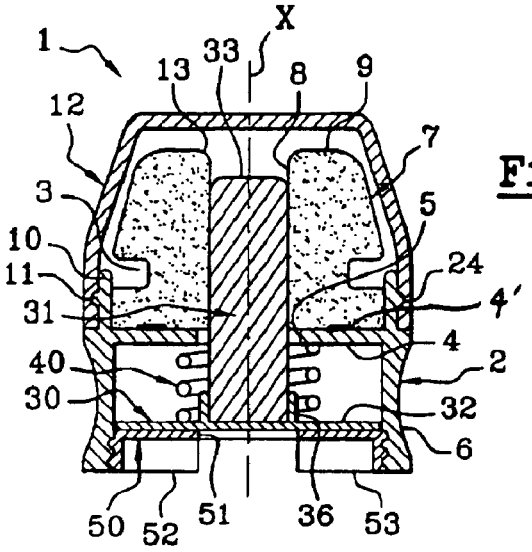
FIGS. 2A–2C illustrate various exemplary aspects of the operation of the embodiment of the applicator assembly of FIG. 1.

In the mounted position, as shown in FIG. 2A, the product stick 31 may be arranged inside the passage 8 defined by the application member 7. The free surface (application surface) 33 of the product may lie below the application face 9. As an indication, the height of the stick 31 may be on the order of 10 mm and the passage 8 may have a height at rest of about 13 mm.

Figure 2B:
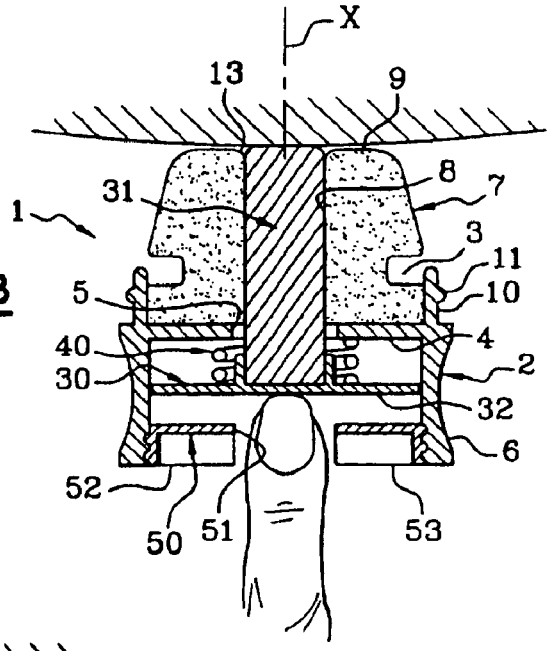
Figure 2C:
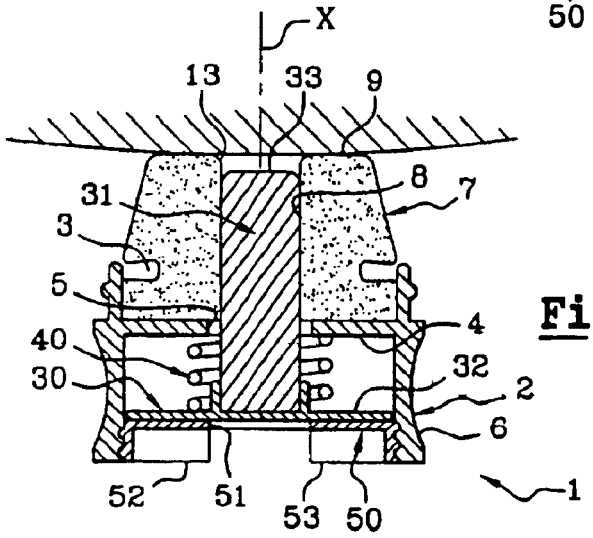

With a view to an application of the product, as illustrated in FIG. 2B, the user may exert an axial force, for example an elastic deformation force, on the wall 32 of the product holder element 30. Access to the wall 32 may take place through the orifice 51. When this is done, the free surface 33 of the product 31 may be brought at least substantially level with, and may be slightly above, the application face 9. The stick of product 31 may then be placed in contact with the skin (or other surface to be treated), and the product 31 may be deposited by moving the free surface 33 of the product 31 over the skin. After a sufficient quantity of product 31 has been applied, the user may relax the force exerted on the wall 32 of the product holder element 30. Under the elastic return force generated by the spring 40, the product holder element 30 and the stick 31 may return into the position of FIG. 2A. The user may subsequently, as indicated in FIG. 2C, smear the applied product by using the application face 9, the free surface 31 of the product being set back from the latter. As the number of uses increases, the amount of product 31, (e.g., the height of the product stick) in the passage 8 may decrease until substantially all of the product 31 has been used.

Figure 3A:
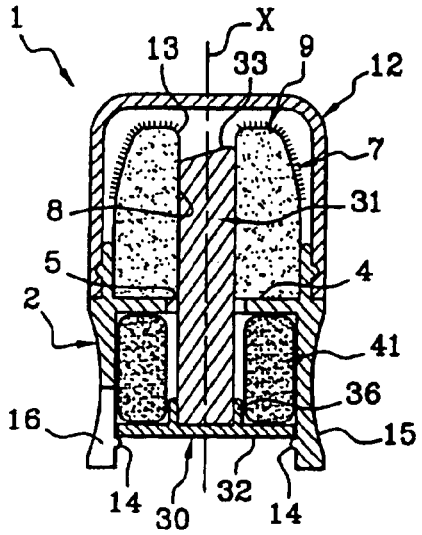
FIGS. 3A–3C are cross-sectional views showing various exemplary aspects of the operation of another exemplary embodiment of an applicator assembly.
Figure 3B:
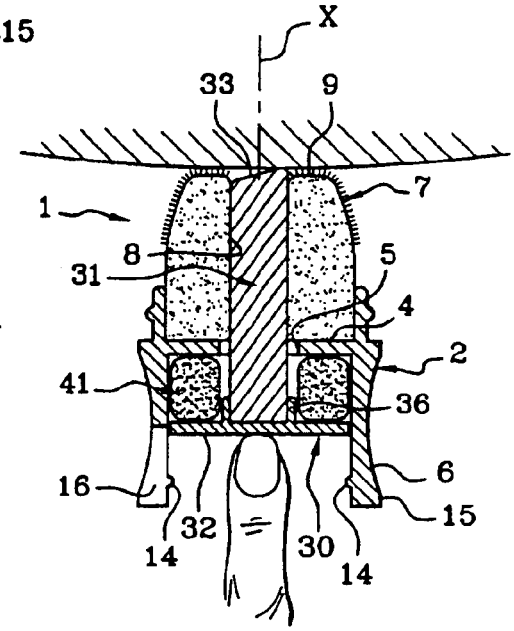
Figure 3C:
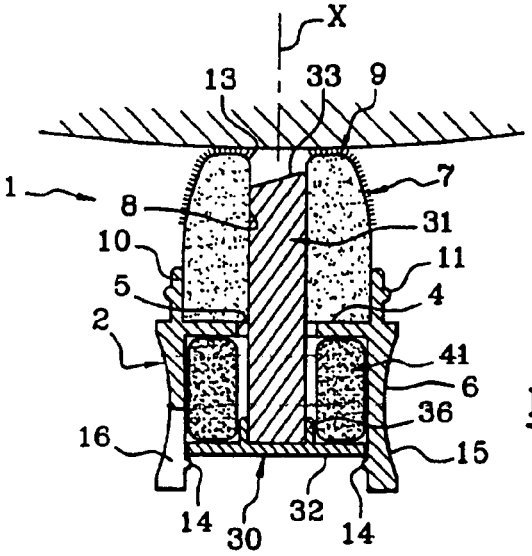

The embodiment illustrated in FIGS. 3A–3C may differ from the embodiment shown in FIGS. 1 and 2A–2C in that the spring 40 may be replaced by an elastically compressible material, such as in the form of a foam block 41. The hardness of the foam block 41 may be greater than the hardness of the foam forming the application member 7, for example. Alternatively, the hardness of the foam element 41 may be less than or equal to the hardness of the foam forming the application member 7.

Also, the product holder element 30 may be held in the mounted position with respect to the support 2 via beads 14, for example, formed on the internal surface of the skirt 6. For example, the beads 14 may be formed on axial tongues 15 formed by the skirt 6. The axial tongues 15 may be are separated from one another and defined by axial slits 16 (e.g., one slit may be positioned between neighboring tongues). When the product holder element 30 is being fitted onto the support 2, it may be possible for the wall 32 of the product holder element 30 to get past the beads 14 owing to the radial elastic deformability of the axial tongues 15.

Figure 6:
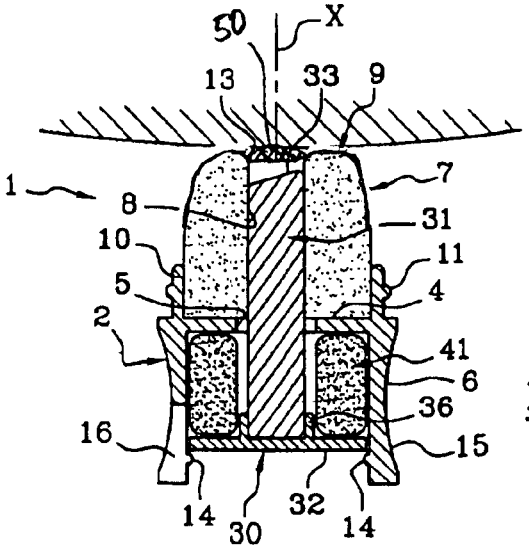
FIG. 6 is a cross-sectional view of yet another exemplary embodiment of an applicator assembly.

The application face 9 may be flocked by means of rayon fibers, for example, as illustrated in FIGS. 3A–3C. Alternatively, a textile material, a weave, or a porous mesh (or screen) may cover the application face. For example, a porous mesh 50 could cover the opening 13 of the passage 8, as shown in FIG. 6. Such a porous mesh 50 could be a separate piece connected to the application member 7 or the mesh 50 and application member 7 could be a unitary, single piece construction.

As shown in FIGS. 3A–3C, the operation of the applicator assembly according to the exemplary embodiment of FIGS. 3A–3C is similar to that of the embodiment described with reference to FIGS. 2A–2C.

Figure 4A:
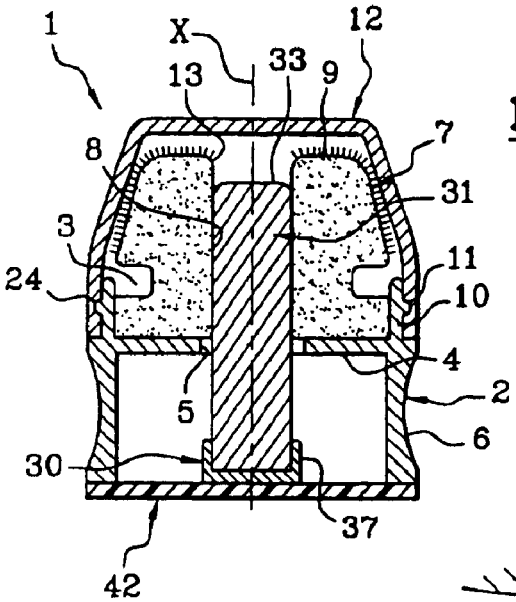
FIGS. 4A–4C are cross-sectional views showing various exemplary aspects of the operation of yet another exemplary embodiment of an applicator assembly.
Figure 4B:
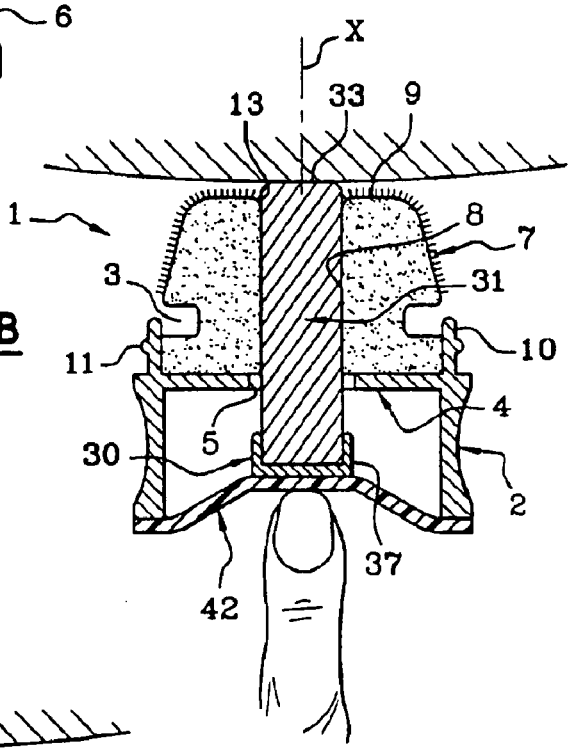
Figure 4C:
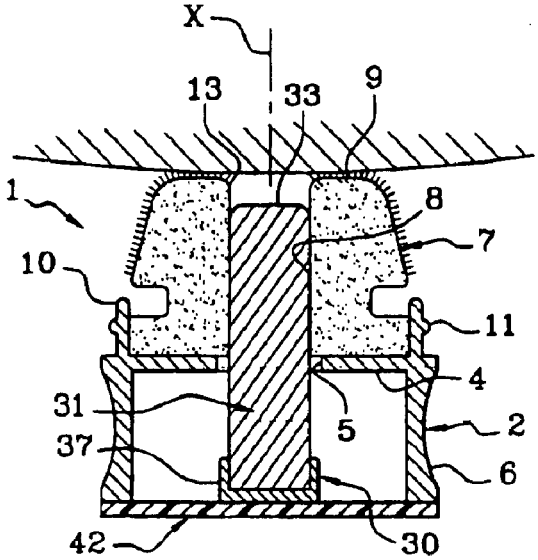

The exemplary embodiment of FIGS. 4A–4C differs from the exemplary embodiments of FIGS. 2A–2C and 3A–3C in that the product holder element 30 may be in the form of a cup 37, that may be adhesively bonded to the center of an elastic diaphragm 42, which may be formed of an elastomeric material, for example, or other suitable elastically deformable materials. The periphery of the diaphragm 42 may be secured to the annular edge of the skirt 6 of the support 2. Furthermore, just as in the exemplary embodiments of FIGS. 2A–2C and 3A–3C, the application face 9 may be flocked or covered with textile, weave, or porous mesh, if desired.

In an alternative, the diaphragm 42 and cup 37 could be molded together as a single unitary piece. In another alternative, the diaphragm 42 could be molded as a single unitary piece with the support 2.

As illustrated in FIGS. 4A–4C, the operation of the application device according to the embodiment of FIGS. 4A–4C is similar to that of the embodiments described with reference to FIGS. 2A–2C and 3A–3C.

Figure 5A:
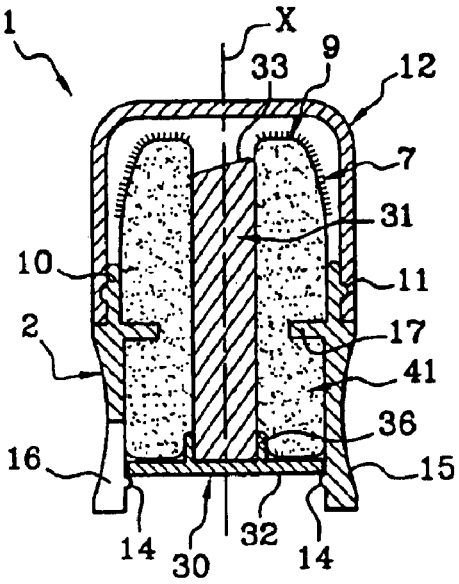
FIGS. 5A–5C are cross-sectional views showing various exemplary aspects of the operation of yet another exemplary embodiment of an applicator assembly.
Figure 5B:
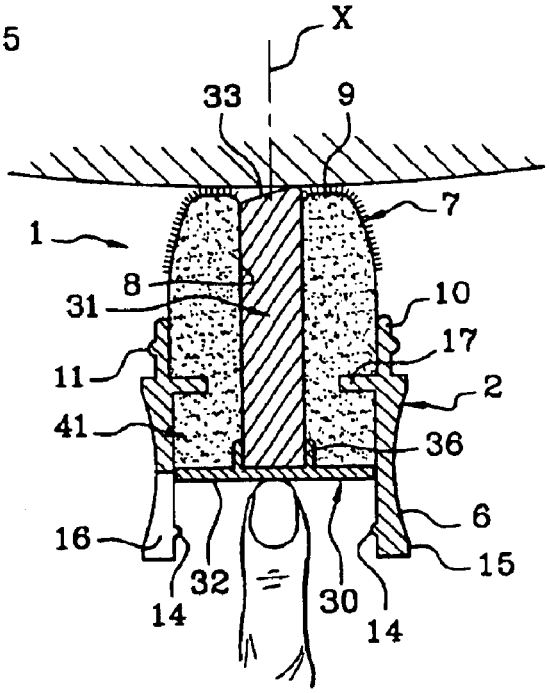
Figure 5C:
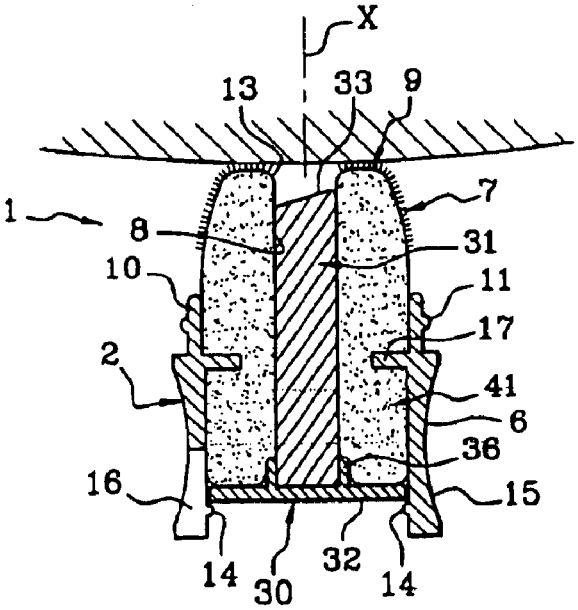

The exemplary embodiment of FIGS. 5A–5C differs from the embodiment of FIGS. 3A–3C in that the block of foam 41, which forms the deformable, elastic return element between the support 2 and the product holder element 30, may be defined by a lower portion of the application member 7. The application member 7 and the deformable, elastic return element 41 may thus be formed, by molding, for example, as a single, unitary piece. A protruding element, for example in the form of a transverse collar 17, may "isolate" the lower portion of the application member 7 forming the elastic return element 41 from the remainder of the application member 7. In this way, in response to axial pressure exerted on the wall 32 of the product holder element 30, the remainder of the application member 7 may be substantially immobile axially, which may allow only the lower portion, and therefore the stick of product 31, to move in the direction of the application face 9.

As illustrated in FIGS. 5A–5C, the operation of the assembly according to the exemplary embodiment of FIGS. 5A–5C is similar to that of the embodiment described above with reference to FIGS. 2A–2C, 3A–3C, and 4A–4C.

Figure 7A:
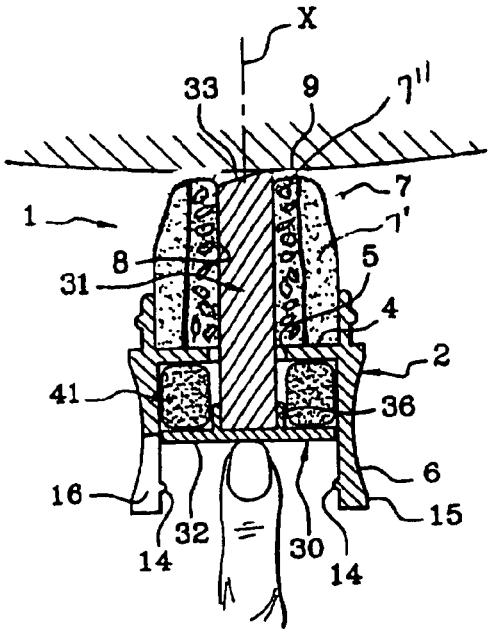
FIGS. 7A and 7B are perspective views of still further exemplary embodiments of an applicator assembly.
Figure 7B:
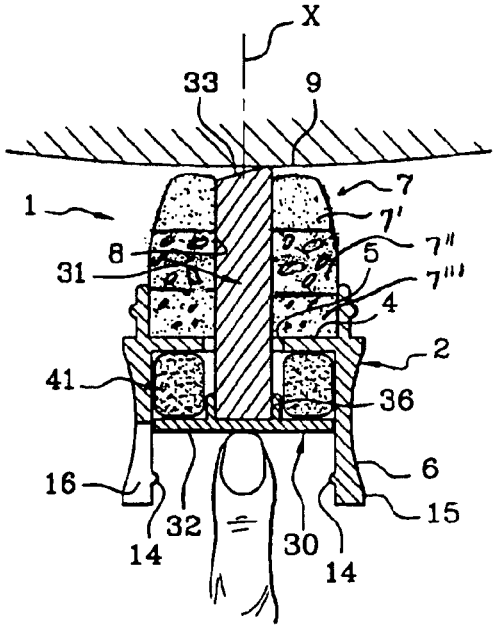

FIGS. 7A and 7B illustrate further exemplary embodiments of an applicator assembly. In FIG. 7A, an applicator assembly 1 comprises an application member 7 defined by a plurality of concentrically disposed foam blocks 7', 7". The foam blocks 7', 7" may be concentrically disposed around the passage 8 defined by the application member 7. The foam blocks 7', 7" may have differing characteristics, such as, for example, differing compressibilities and/or differing surface textures, and/or the like. The differing characteristics may be obtained by using foam blocks 7', 7" made of differing materials and/or treated in differing manners, for example. In this way, application of the product and treatment of the surface may be obtained in differing ways by using differing portions of the application face of the application member 7.

FIG. 7B illustrates another exemplary embodiment of an applicator assembly 1 in which the application member 7 comprises a plurality of foam blocks, 7', 7", 7'" that may be vertically stacked upon each other. As with the embodiment of FIG. 7A, the various foam blocks 7', 7", 7'" also may having differing characteristics, such as differing compressibilities and/or differing surface textures, and/or the like. The differing characteristics may be obtained by using foam blocks 7', 7", 7'", made of differing materials and/or treated in differing manners, for example. In this way, application of the product and treatment of the surface may be obtained in differing ways by using differing portions of the application member 7. Each of the foam blocks 7', 7", 7'" may define a cavity such that when the blocks are stacked vertically, the cavities define the passage 8.

It will be apparent to those skilled in the art that various modifications and variations can be made to the structures and methodologies described herein. For example, although much of the above detailed description related to an applicator assembly and use of the applicator assembly to apply a cosmetic product, it should be understood that the applicator assemblies described herein are not limited to such use, and may be used in conjunction with the application of numerous types of products, including, but not limited to, polishes of all types, paints, deodorants, and other similar products. Thus, it should be understood that the invention is not limited to the examples discussed in the specification. Rather, modifications and variations are intended to be covered.

What is claimed is:

1. An applicator assembly, comprising:

a product comprising a first end portion and a second end portion opposite to the first end portion, wherein the first end portion comprises a first portion surface;

at least one application member surrounding at least part of the product, wherein the application member comprises an application face; and an actuatable product holder movable relative to the application member, the second end portion of the product being held by the product holder, wherein the assembly is configured such that, in the absence of actuation of the product holder, the first portion surface is disposed in a first position located substantially level with or below the application face, wherein the assembly is configured such that actuation of the product holder causes the first portion surface to be moved to at least a second position relative to application face, the second position differing from the first position, wherein the assembly is configured such that the first portion surface elastically returns to substantially the first position when actuation of the product holder ceases, and wherein the assembly is configured such that, in the absence of actuation of the product holder, the application face is capable of becoming substantially level with the first portion surface or is substantially level with the first portion surface.

2. The applicator assembly of claim 1, wherein the assembly is configured such that, in the absence of actuation of the product holder, the application face is capable of becoming substantially level with the first portion surface in response to force exerted on the application member.

3. The applicator assembly of claim 2, wherein the application face is capable of becoming substantially level with the first portion surface in response to an axial force exerted on the application face and directed toward the first portion surface of the product.

4. The applicator assembly of claim 1, wherein the application member comprises an end located opposite to the application face and, in the first position, the first portion surface of the product is located between the end and the application face.

5. The applicator assembly of claim 1, wherein the application member defines a passage extending through a dimension of the application member, the passage defining an opening in the application face.

6. The applicator assembly of claim 5, wherein the first portion surface of the product is configured to move through the opening in response to the actuation of the product holder.

7. The applicator assembly of claim 1, wherein the application member is at least partially elastically compressible.

8. The applicator assembly of claim 1, wherein the application member comprises an elastically compressible material.

9. The applicator assembly of claim 8, wherein the application member comprises a foam element.

10. The applicator assembly of claim 1, wherein the elastic return is caused by an elastically deformable element that is configured to elastically deform in response to actuation of the product holder.

11. The applicator assembly of claim 10, wherein the elastically deformable element is chosen from a spring, an elastically compressible element, and a diaphragm made of elastic material.

12. The applicator assembly of claim 11, wherein the elastically compressible element comprises a foam block.

13. The applicator assembly of claim 1, further comprising a support for holding the application member.

14. The applicator assembly of claim 13, wherein the application member is coupled to the support by a coupling mechanism chosen from adhesive bonding, welding, crimping, and magnetic attraction.

15. The applicator assembly of claim 13, further an elastically deformable element having a first portion coupled to the support and a second portion coupled to the product holder, the elastically deformable element causing the elastic return.

16. The applicator assembly of claim 15, wherein the elastically deformable element is chosen from a spring, a diaphragm made of an elastic material, and an elastically compressible element.

17. The applicator assembly of claim 13, wherein the support is hollow and comprises a first end on which the application member is configured to be mounted and a second open end configured to receive the product holder.

18. The applicator assembly of claim 17, wherein the first end of the support terminates in an annular wall.

19. The applicator assembly of claim 18, further comprising a removable plug configured to be engaged with the support proximate the second open end and configured to maintain the product holder in a mounted position relative to the support.

20. The applicator assembly of claim 19, wherein the removable plug defines an opening configured to permit access to the product holder so as to actuate the product holder.

21. The applicator assembly of claim 19, further comprising at least one bead formed on an internal surface of the support proximate the second open end, the at least one bead being configured to retain the product holder in a mounted position relative to the support.

22. The applicator assembly of claim 19, further an elastic diaphragm configured to be coupled to the support and to the product holder, the elastic diaphragm causing the elastic return.

23. The applicator assembly of claim 22, wherein the elastic diaphragm has a peripheral portion configured to be coupled to the support and a central portion configured to be coupled to the product holder.

24. The applicator assembly of claim 22, wherein the elastic diaphragm is configured to be coupled to the support proximate the second open end.

25. The applicator assembly of claim 1, wherein the product holder is configured to be removably mounted relative to the application member.

26. The applicator assembly of claim 13, wherein the holder is configured to be removably mounted relative to the support.

27. The applicator assembly of claim 5, wherein the passage has a substantially constant cross-section.

28. The applicator assembly of claim 27, wherein the entire cross-sectional area of the passage opens out onto the application face via the opening.

29. The applicator assembly of claim 1, further comprising an elastic element molded as a single piece with one of the product holder and the application member, the elastic element causing the elastic return.

30. The applicator assembly of claim 13, further comprising an elastic element molded as a single piece with one of the product holder, the application member, and the support, the elastic element being configured to cause the elastic return.

31. The applicator assembly of claim 1, further comprising a lid configured to cover the application face.

32. The applicator assembly of claim 31, wherein the lid is removable from a covering position covering the application face.

33. The applicator assembly of claim 13, wherein the support is configured to be grasped for holding the application member.

34. The applicator assembly of claim 1, wherein the application member comprises at least one block of foam having one of open cells, semi-open cells, and closed cells.

35. The applicator assembly of claim 1, wherein the application member is made of a material chosen from polyvinyl chlorides, polyurethanes, polyethers, polyesters, elastomers of styrene butadiene rubber, elastomers of acrylonitrile butadiene rubber, elastomers of silicone, and elastomers of nitrile.

36. The applicator assembly of claim 1, wherein the application member is configured to be one of uniformly and preferentially compressible.

37. The applicator assembly of claim 36, wherein the application member comprises at least one groove formed on at least a portion of th application member.

38. The applicator assembly of claim 37, wherein the at least one groove is on an exterior surface of the application member.

39. The applicator assembly of claim 1, wherein the application member comprises one of flocking, a textile, a weave, and a screen on an exterior surface portion of the application member.

40. The applicator assembly of claim 1, wherein the product is in the form of a stick.

41. The applicator assembly of claim 1, wherein the product is chosen from blushes, face powders, eyeshadows, lip make-ups, rouges, foundations, care products, sun protection products, self-tanning products, and hair products.

42. The applicator assembly of claim 1, wherein the product comprises a make-up product.

43. The applicator assembly of claim 1, wherein the product holder is configured to fixedly hold the product.

44. The applicator assembly of claim 1, wherein a portion of the application member is configured to cause the elastic return.

45. The applicator assembly of claim 44, wherein the application member comprises an elastically compressible material.

46. The applicator assembly of claim 45, wherein of the product holder causes elastic compression of the portion of the application member.

47. The applicator assembly of claim 46, further comprising a protruding member that engages the application member so as to isolate compression of the portion of the application member from the remainder of the application member.

48. The applicator assembly of claim 45, wherein the portion has a compressibility that differs from a compressibility of the remainder of th application member.

49. The applicator assembly of claim 44, wherein the portion of the application member is configured to be engaged with the product holder.

50. The applicator assembly of claim 1, wherein the at least one application member comprises a plurality of foam blocks.

51. The applicator assembly of claim 50, wherein the foam blocks are concentrically disposed with respect to each other.

52. The applicator assembly of claim 50, wherein the foam blocks are stacked vertically upon each other.

53. The applicator assembly of claim 1, wherein the first portion surface is configured to move in an axial direction between the first position and the second position.

54. An applicator system comprising:

the applicator assembly of claim 1; and at least one additional application member.

55. The applicator system of claim 54, wherein each of the application members has an application face for applying product, each of the application faces having a differing characteristic.

56. The applicator system of claim 54, wherein each of the application members has a differing compressibility.

57. The applicator system of claim 54, further comprising at least one additional product holder, wherein each of the product holders holds a product having a differing characteristic.

58. The applicator system of claim 57, wherein the differing characteristic is chosen from at least one of product type and product color.

59. An applicator system comprising: the applicator assembly of claim 1; and at least one additional product holder.

60. The applicator system of claim 59, further corn rising at least one additional application member, wherein each of the application members has an application face for applying product, each of the application faces having differing characteristic.

61. The applicator system of claim 59, further comprising at least one additional application member, wherein each of the application members has a differing compressibility.

62. The applicator system of claim 59, wherein each of the product holders holds a product having a differing characteristic.

63. The applicator system of claim 62, wherein the differing characteristic is chosen from at least one of product type and product color.

64. A method of applying a product to a surface to be treated, the method comprising:

providing the applicator assembly of claim 1;

placing the application face of the application member in contact with the surface to be treated; and placing the first portion surface of the product in contact with the surface to be treated.

65. The method of claim 64, wherein the placing of the application face in contact with the surface to be treated comprises compressing the application member.

66. The method of claim 65, wherein the of the application member causes the application face to be brought substantially level with the first portion surface of the product so as to enable the placing of the product in contact with the surface to be treated.

67. The method of claim 64, further comprising actuating the product holder so as to move the first portion surface of the product to the second position, wherein the first portion surface of the product one of protrudes beyond the application face and is substantially level with the application face.

68. The method of claim 67, further comprising ceasing the actuating of the product holder after product has been applied so as to use the elastic return of the first portion surface of the product to substantially the first position.

69. The method of claim 68, further comprising smearing the applied product using the application face.

70. The method of claim 69, wherein the smearing of the applied product occurs after the first portion surface of the product has elastically returned to substantially the first position.

71. An applicator assembly, comprising:

at least one application member comprising an application face, the application member defining a passage having an opening in the application face;

an elastically moveable product holder configured to be capable of being moved relative to the application member in the absence of a force exerted on the application face and configured to hold the product such that at least part of the product is received in the passage, wherein the assembly is configured such that, in response to exertion of an elastic deformation force on the product holder, a surface of the product moves relative to the application member from a first position wherein the product surface does not protrude beyond the opening to at least a second position wherein the product surface one of protrudes beyond the opening and is substantially level with the opening.

72. The applicator assembly of claim 71, wherein, in response to the removal of the exertion of the elastic deformation force on the product holder, the product surface elastically returns to substantially the first position.

73. The applicator assembly of claim 71, wherein, in the absence of the elastic deformation force exerted on the product holder, the application face is capable of being brought substantially level with or is substantially level with the product surface.

74. The applicator assembly of claim 73, wherein the application face is capable of being brought substantially level with the product surface by exerting a force on the application member.

75. The applicator assembly of claim 74, wherein the application face is capable of being brought substantially level with the product surface by exerting an axial force on the application face in a direction toward the product surface.

76. The applicator assembly of claim 71, wherein the application member comprises an end located opposite to the application face and, in the first position, the product surface is located between the end and the application face.

77. The applicator assembly of claim 71, wherein the passage extends through a dimension of the application member.

78. The applicator assembly of claim 77, wherein the product surface is configured to move through the opening in response to the elastic deformation force exerted on the product holder.

79. The applicator assembly of claim 71, wherein the application member is at least partially elastically compressible.

80. The applicator assembly of claim 71, wherein the application member comprises an elastically compressible material.

81. The applicator assembly of claim 80, wherein the application member comprises a foam element.

82. The applicator assembly of claim 71, further comprising an elastically deformable element configured to elastically deform to cause elastic movement of the product holder.

83. The applicator assembly of claim 82, wherein the elastically deformable element is chosen from a spring, an elastically compressible element, and a diaphragm made of elastic material.

84. The applicator assembly of claim 83, wherein the elastically compressible element comprises a foam element.

85. The applicator assembly of claim 71, further comprising a support for holding the application member.

86. The applicator assembly of claim 85, wherein the application member is coupled to the support by a coupling mechanism chosen from adhesive bonding, welding, crimping, and magnetic attraction.

87. The applicator assembly of claim 85, further comprising an elastically deformable element having a first portion coupled to the support and a second portion coupled to the product holder, the elastically deformable element causing the elastic movement of the product holder.

88. The applicator assembly of claim 87, wherein the elastically deformable element is chosen from a spring, a diaphragm made of an elastic material, and an elastically compressible element.

89. The applicator assembly of claim 88, wherein the elastically compressible element comprises a foam element.

90. The applicator assembly of claim 85, wherein the support is hollow and comprises a first end on which the application member is configured to be mounted and a second open end configured to receive the product holder.

91. The applicator assembly of claim 90, wherein the first end of the support terminates in an annular wall.

92. The applicator assembly of claim 90, further comprising a removable plug configured to be engaged with the support proximate the second open end and configured to maintain the product holder in a mounted position relative to the support.

93. The applicator assembly of claim 92, wherein the removable plug defines an opening configured to permit access to the product holder so as to exert the elastic deformation force on the product holder.

94. The applicator assembly of claim 90, further comprising at least one bead formed on an internal surface of the support proximate the second open end, the at least one bead being configured to retain the product holder in a mounted position relative to the support.

95. The applicator assembly of claim 90, further comprising an elastic diaphragm configured to be coupled to the support and to the product holder, the elastic diaphragm causing the elastic movement of the product holder.

96. The applicator assembly of claim 95, wherein the elastic diaphragm has a peripheral portion configured to be coupled to the support and a central portion configured to be coupled to the product holder.

97. The applicator assembly of claim 95, wherein the elastic diaphragm is configured to be coupled to the support proximate the second open end.

98. The applicator assembly of claim 71, wherein the product holder is configured to be removably mounted relative to the application member.

99. The applicator assembly of claim 85, wherein the product holder is configured to be removably mounted to the support.

100. The applicator assembly of claim 71, wherein the passage has a substantially constant cross-section.

101. The applicator assembly of claim 100, wherein the entire cross-sectional area of the passage opens out onto the at least one application face via the opening.

102. The applicator assembly of claim 71, further comprising an elastic element molded as a single piece with one of the product holder and the application member, the elastic element causing the elastic movement of the product holder.

103. The applicator assembly of claim 85, further an elastic element molded as a single piece with one of the product holder, the application member, and the support, the elastic element being configured to cause the elastic movement of the product holder.

104. The applicator assembly of claim 71, further comprising a lid configured to cover the application face.

105. The applicator assembly of claim 104, wherein the lid is removable from a covering position covering the application face.

106. The applicator assembly of claim 85, wherein the support is configured to be grasped for holding the application member.

107. The applicator assembly of claim 71, wherein the application member comprises at least one block of foam having one of open cells, semi-open cells, and closed cells.

108. The applicator assembly of claim 71, wherein the application member is made of a material chosen from polyvinyl chlorides, polyurethanes, polyethers, polyesters, elastomers of styrene butadiene rubber, elastomers of acrylonitrile butadiene rubber, elastomers of silicone, and elastomers of nitrile.

109. The applicator assembly of claim 71, wherein the application member is configured to be one of uniformly and preferentially compressible.

110. The applicator assembly of claim 109, wherein the application member comprises at least one groove formed on at least a portion of the application member.

111. The applicator assembly of claim 110, wherein the at least one groove is on an exterior surface of the application member.

112. The applicator assembly of claim 71, wherein the application member comprises one of flocking, a textile, a weave, and a screen on an exterior surface portion of the application member.

113. The applicator assembly of claim 71, further the product, wherein the product is held by the product holder.

114. The applicator assembly of claim 113, wherein the product is in the form of a stick.

115. The applicator assembly of claim 113, wherein the product is chosen from blushes, face powders, eyeshadows, lip make-ups, rouges, foundations, care products, sun protection products, self-tanning products, and hair products.

116. The applicator assembly of claim 113, wherein the product comprises a make-up product.

117. The applicator assembly of claim 71, wherein the product holder is configured to fixedly hold the product.

118. The applicator assembly of claim 71, wherein a portion of the application member is configured to cause the elastic movement of the product holder.

119. The applicator assembly of claim 118, wherein the application member comprises an elastically compressible material.

120. The applicator assembly of claim 119, wherein the elastic deformation force exerted on the product holder causes elastic compression of the portion of the application member.

121. The applicator assembly of claim 120, further comprising a protruding member that engages the application member so as to isolate compression of the portion of the application member from the remainder of the application member.

122. The applicator assembly of claim 119, wherein the portion has a compressibility that differs from the remainder of the application member.

123. The applicator assembly of claim 118, wherein the portion of the application member is configured to be engaged with the product holder.

124. The applicator assembly of claim 71, wherein the product surface is configured to move in an axial direction between the first position and the second position.

125. An applicator system comprising:

the applicator assembly of claim 71; and at least one additional application member.

126. The applicator system of claim 125, wherein each of the application members has an application face for applying product, each of the application faces having a differing characteristic.

127. The applicator system of claim 125, wherein each of the application members has a differing compressibility.

128. The applicator system of claim 125, further at least one additional product holder, wherein each of the product holders holds a product having a differing characteristic.

129. The applicator system of claim 128, wherein the differing characteristic is chosen from at least one of product type and product color.

130. An applicator system comprising:

the applicator assembly of claim 71; and at least one additional product holder.

131. The applicator system of claim 130, further comprising at least one additional application member, wherein each of the application members has an application face for applying product, each of the application faces having a differing characteristic.

132. The applicator system of claim 130, further comprising at least one additional application member, wherein each of the application members has a differing compressibility.

133. The applicator system of claim 130, wherein each of the product holders holds a product having a differing characteristic.

134. The applicator system of claim 133, wherein the differing characteristic is chosen from at least one of product type and product color.

135. A method of applying a product to a surface to be treated, the method comprising:

providing the applicator assembly of claim 71, wherein a product is held by the product holder;

placing the application face of the application member in contact with, the surface to be treated; and placing the product surface in contact with the surface to be treated.

136. The method of claim 135, wherein the placing of the application face in contact with the surface to be treated comprises compressing the application member.

137. The method of claim 136, wherein the compressing of the application member causes the application face to be brought substantially level with the product surface so as to enable the placing of the product in contact with the surface to be treated.

138. The method of claim 135, further comprising exerting an elastic deformation force on the product holder so as to move the product surface to the second position, wherein the product surface protrudes beyond the application face or is substantially level with the application face.

139. The method of claim 138, further comprising removing the elastic deformation force from the product holder after product has been applied so as to cause the product surface to elastically return to substantially the first position.

140. The method of claim 139, further comprising smearing the applied product using the application face.

141. The method of claim 140, wherein the smearing of the applied product occurs after the product surface has elastically returned to substantially the first position.

142. An applicator assembly, comprising:

at least one at least partially elastically compressible application member comprising an application face, the application member defining a passage having an opening in the at least one application face; and an elastically moveable product holder configured to be capable of being moved relative to the application member in the absence of a force exerted on the application face and configured to hold the product such that at least part of the product is received in the passage, wherein the assembly is configured such that, in response to movement of the product holder relative to the application member, a surface of the product elastically moves relative to the application member.

143. The applicator assembly of claim 142, wherein the assembly is configured such that the product surface moves between a first position therein the product surface does not protrude beyond the opening to at least a second position wherein the product surface is substantially level with the opening or protrudes beyond the opening.

144. The applicator assembly of claim 143, wherein the product surface moves to at least the second position in response to a force exerted on the product holder and wherein the product surface returns to substantially the first position in response to removal of the force on the product holder.

145. The applicator assembly of claim 144, wherein the force comprises an elastic deformation force.

146. The applicator assembly of claim 142, wherein, in the absence of movement of the product holder relative to the application member, the application face is capable of being brought substantially level with or is substantially level with the product surface.

147. The applicator assembly of claim 146, wherein the application face is capable of being brought substantially level with the product surface in response to axial pressure exerted on the application face and directed toward the product surface.

148. The applicator assembly of claim 143, wherein the application member comprises an end located opposite to the application face and, in the first position, the product surface is located between the end and the application face.

149. The applicator assembly of claim 142, wherein the passage extends through a dimension of the application member.

150. The applicator assembly of claim 149, wherein the product surface is configured to move through the opening in response to movement of the product holder.

151. The applicator assembly of claim 142, wherein the application member comprises a foam element.

152. The applicator assembly of claim 142, further comprising an elastically deformable element configured to elastically deform to cause elastic movement of the product holder.

153. The applicator assembly of claim 152, wherein the elastically deformable element is chosen from a spring, an elastically compressible element, and a diaphragm made of elastic material.

154. The applicator assembly of claim 153, wherein the elastically compressible element comprises a foam element.

155. The applicator assembly of claim 142, further comprising a support for holding the application member.

156. The applicator assembly of claim 155, wherein the application member is coupled to the support by a coupling mechanism chosen from adhesive bonding, welding, crimping, and magnetic attraction.

157. The applicator assembly of claim 155, further comprising an elastically deformable element having a first portion coupled to the support and a second portion coupled to the product holder, the elastically deformable element causing the elastic movement of the product holder.

158. The applicator assembly of claim 157, wherein the elastically deformable element is chosen from a spring, a diaphragm made of an elastic material, and an elastically compressible element.

159. The applicator assembly of claim 158, wherein the elastically compressible element comprises a foam element.

160. The applicator assembly of claim 155, wherein the support is hollow and comprises a first end on which the application member is configured to be mounted and a second open end configured to receive the product holder.

161. The applicator assembly of claim 160, wherein the first end of the support terminates in an annular wall.

162. The applicator assembly of claim 160, further comprising a removable plug configured to be engaged with the support proximate the second open end and configured to maintain the product holder in a mounted position relative to the support.

163. The applicator assembly of claim 162, wherein the removable plug defines an opening configured to permit access to the product holder so as to move the product holder.

164. The applicator assembly of claim 160, further comprising at least one bead formed on an internal surface of the support proximate the second open end, the at least one bead being configured to retain the product holder in a mounted position relative to the support.

165. The applicator assembly of claim 160, further comprising an elastic diaphragm configured to be coupled to the support and to the product holder, the elastic diaphragm causing the elastic movement of the product holder.

166. The applicator assembly of claim 165, wherein the elastic diaphragm has a peripheral portion configured to be coupled to the support and a central portion configured to be coupled to the product holder.

167. The applicator assembly of claim 165, wherein the elastic diaphragm is configured to be coupled to the support proximate the second open end.

168. The applicator assembly of claim 142, wherein the product holder is configured to be removably mounted relative to the application member.

169. The applicator assembly of claim 155, wherein the product holder is configured to be removably mounted to the support.

170. The applicator assembly of claim 142, wherein the passage has a substantially constant cross-section.

171. The applicator assembly of claim 170, wherein the entire cross-sectional area of the passage opens out onto the application face via the opening.

172. The applicator assembly of claim 142, further comprising an elastic element molded as a single piece with one of the product holder and the application member, the elastic element causing the elastic movement of the product holder.

173. The applicator assembly of claim 155, further comprising an elastic element molded as a single piece with one of the product holder, the application member, and the support, the elastic element being configured to cause the elastic movement of the product holder.

174. The applicator assembly of claim 142, further comprising a lid configured to cover the application face.

175. The applicator assembly of claim 174, wherein the lid is removable from a covering position covering the application face.

176. The applicator assembly of claim 155, wherein the support is configured to be grasped for holding the application member.

177. The applicator assembly of claim 142, wherein the application member comprises at least one block of foam having one of open cells, semi-open cells, and closed cells.

178. The applicator assembly of claim 142, wherein the application member is made of a material chosen from polyvinyl chlorides, polyurethanes, polyethers, polyesters, elastomers of styrene butadiene rubber, elastomers of acrylonitrile butadiene rubber, elastomers of silicone, and elastomers of nitrile.

179. The applicator assembly of claim 142, wherein the application member is configured to be one of uniformly and preferentially compressible.

180. The applicator assembly of claim 179, wherein the application member comprises at least one groove formed on at least a portion of the application member.

181. The applicator assembly of claim 180, wherein the at least one groove is on an exterior surface of the application member.

182. The applicator assembly of claim 142, wherein the application member comprises one of flocking, a textile, a weave, and a screen on and exterior surface portion of the application member.

183. The applicator assembly of claim 142, further comprising the product, wherein the product is held by the product holder.

184. The applicator assembly of claim 183, wherein the product is in the form of a stick.

185. The applicator assembly of claim 183, wherein th product is chosen from blushes, face powders, eyeshadows, lip make-ups, rouges, foundations, care products, sun protection products, self-tanning products, and hair products.

186. The applicator assembly of claim 183, wherein the product comprises a make-up product.

187. The applicator assembly of claim 142, wherein the product holder is configured to fixedly hold the product.

188. The applicator assembly of claim 142, wherein a portion of the application member is configured to cause the elastic movement of the product holder.

189. The applicator assembly of claim 188, wherein the portion of the application member is configured to be engaged with the product holder.

190. The applicator assembly of claim 188, wherein th elastic compression of the portion of the application member causes movement of the product holder.

191. The applicator assembly of claim 190, further a protruding member that engages the application member so as to isolate compression of the portion of the application member from the remainder of the application member.

192. The applicator assembly of claim 188, wherein the portion has a compressibility that differs from the remainder of the application member.

193. The applicator assembly of claim 143, wherein the product surface is configured to move in an axial direction between the first position and the second position.

194. An applicator system comprising:

the applicator assembly of claim 142; and at least one additional application member.

195. The applicator system of claim 194, wherein each of the application members has an application face for applying product, each of the application faces having a differing characteristic.

196. The applicator system of claim 194, wherein etch of the application members has a differing compressibility.

197. The applicator system of claim 194, further comprising at least one additional product holder, wherein each of the product holders holds a product having a differing characteristic.

198. The applicator system of claim 197, wherein the differing characteristic is chosen from at least one of product type and product color.

199. An applicator system comprising:

the applicator assembly of claim 142; and at least one additional product holder.

200. The applicator system of claim 199, further comprising at least one additional application member, wherein each of the application members has an application face for applying product, each of the application faces having a differing characteristic.

201. The applicator system of claim 199, further comprising at least one additional application member, wherein each of the application members has a differing compressibility.

202. The applicator system of claim 199, wherein each of the product holders holds a product having a differing characteristic.

203. The applicator system of claim 202, wherein the differing characteristic is chosen from at least one of product type and product color.

204. A method of applying a product to a surface to be treated, the method comprising:

providing the applicator assembly of claim 142, wherein a product is held by the product holder;

placing the application face of the application member in contact with the surface to be treated; and placing the product surface in contact with the surface to be treated.

205. The method of claim 204, wherein the placing of the application face in contact with the surface to be treated comprises compressing the application member.

206. The method of claim 205, wherein the compressing of the application member causes the application face to be brought substantially level with the product surface so as to enable the placing of the product surface in contact with the surface to be treated.

207. The method of claim 204, further comprising exerting a force on the product holder so as to elastically move the product holder relative to the application member so as to move the product surface from a first position to at least a second position, wherein the product surface protrudes beyond the application face or is substantially level with the application face.

208. The method of claim 207, further comprising removing the force from the product holder after product has been applied so as to cause the product surface to elastically return to substantially the first position.

209. The method of claim 208, further comprising smearing the applied product using the application face.

210. The method of claim 209, wherein the smearing of the applied product occurs after the product surface has elastically returned to substantially the first position.

211. The applicator assembly of claim 1, wherein the product holder is movable relative to the application member in the absence of a force applied to the application face.

* * * * *

UNITED STATES PATENT AND TRADEMARK OFFICE

CERTIFICATE OF CORRECTION

PATENT NO. : 6,890,115 B2
APPLICATION NO. : 10/316104
DATED : May 10, 2005
INVENTOR(S) : Kristell Le Moing It is certified that error appears in the above-identified patent and that said Letters Patent is hereby corrected as shown below:

Title page,
Item [75], Inventor, "Krist ll" should read -- Kristell --.
Item [57], ABSTRACT, delete in its entirety and substitute:
-- An applicator assembly may comprise a product comprising a first end portion having a first portion surface and a second end portion opposite to the first end portion, and at least one application member surrounding at least part of the product, the application member comprising an application face, and a actuatable product holder movable relative to the application member, the second end portion of the product being held by the product holder. Actuation of the product holder may cause the first portion surface to be moved to at least a second position relative to application face. In the absence of the product holder, the application face may be capable of becoming substantially level with the first portion surface or may be substantially level with the first portion surface. --.

Column 13,
Line 53, after "further", insert -- comprising --.

Column 14,
Line 14, after "further", insert -- comprising --.
Line 28, after "wherein the", insert -- product --.
Line 67, "of th" should read -- of the --.

Column 15,
Line 24, after "wherein", insert -- actuation --.
Line 34, "of th" should read -- of the --.

Column 16,
Line 1, "corn rising" should read -- comprising --.
Line 4, "having" and before "differing", insert -- a --.
Line 25, after "wherein the", insert -- compressing --.
Line 37, "to use" should read -- to cause --.

Column 18,
Line 37, after "further", insert -- comprising --.

Column 19,
Lines 5 and 50, after "further", insert -- comprising --.

Column 20,
Line 12, after "with", delete the comma.
Line 54, "therein" should read -- wherein --.

UNITED STATES PATENT AND TRADEMARK OFFICE

CERTIFICATE OF CORRECTION

PATENT NO. : 6,890,115 B2
APPLICATION NO. : 10/316104
DATED : May 10, 2005
INVENTOR(S) : Kristell Le Moing It is certified that error appears in the above-identified patent and that said Letters Patent is hereby corrected as shown below:

Column 22,
Line 59, “and exterior” should read -- an exterior --.
Line 66, “wherein th” should read -- wherein the --.

Column 23,
Line 13, “wherein th” should read -- wherein the --.
Line 16, after “further”, insert -- comprising --.
Line 33, “etch” should read -- each --.

Signed and Sealed this

Twenty-seventh Day of June, 2006

JON W. DUDAS
*Director of the United States Patent and Trademark Office*